US005944560A

United States Patent [19]

Pill

[11] Patent Number: 5,944,560

[45] Date of Patent: Aug. 31, 1999

[54] FRAME STRUCTURE FOR MOUNTING AN ELECTRICAL CONNECTOR

[75] Inventor: Anthony J. Pill, Aurora, Ill.

[73] Assignee: Molex Incorporated, Lisle, Ill.

[21] Appl. No.: 08/924,854

[22] Filed: Sep. 5, 1997

[51] Int. Cl.[6] ..... H01R 13/502

[52] U.S. Cl. ..... 439/701; 439/248

[58] Field of Search ..... 439/247, 248, 439/701, 405

[56] References Cited

U.S. PATENT DOCUMENTS 4,252,396 2/1981 Wilson ..... 439/405
5,651,683 7/1997 Shimamura et al. ..... 439/34
5,725,397 3/1998 Fukamachi et al. ..... 439/701

*Primary Examiner*—Paula Bradley
*Assistant Examiner*—Katrina Davis
*Attorney, Agent, or Firm*—Stacey E. Caldwell

[57] ABSTRACT

A frame structure is provided for mounting an electrical connector assembly. The structure includes a generally U-shaped first frame piece having a pair of generally parallel arms for embracing opposite sides of the connector assembly inserted into an open side of the frame piece defined by the U-shaped configuration thereof. A second frame piece closes the open side of the first frame piece to capture the connector assembly therewithin. Latches are provided between opposite ends of the second frame piece and free ends of the arms of the U-shaped first frame piece to hold the frame pieces together about the connector assembly.

18 Claims, 11 Drawing Sheets

FRAME STRUCTURE FOR MOUNTING AN ELECTRICAL CONNECTOR

FIELD OF THE INVENTION

This invention generally relates to the art of electrical connectors and, particularly, to a frame structure for mounting an electrical connector assembly.

BACKGROUND OF THE INVENTION

Generally, electrical connectors typically include a housing mounting a plurality of electrically conductive terminals therein. The housing usually is fabricated of nonconductive material and may be partly or entirely molded from plastic. The housing includes a mating end with structure that permits mating and unmating with a second electrical connector. The second electrical connector may be mounted to wires, a cable, a circuit board or other electrical lead means.

Often, electrical connectors are mounted in a panel or other appropriate support structure, the panel may be mountable in an aperture in the support structure. Many prior art connectors of this general type include separate means for achieving secure mounting of the connector to the support structure, For example, separate retaining means, such as bolts, clips or the like rigidly secure the connector housing to the support structure. Integral latches also have been used to avoid the need for separate retaining means. The latches typically are molded integrally with the connector housing to reduce costs, to facilitate assembly and to avoid inventory control problems.

On the other hand, many electrical connectors are employed in blind mating environments wherein precise alignment of the connectors during mating cannot always be assured. For example, an electrical connector mounted to a panel or other appropriate support structure may be disposed at a relatively inaccessible location in an automobile or other vehicle. Even if the connector location is not actually inaccessible, it often is desirable to provide for a degree of relatives movement between the electrical connector and its support structure during mating with the second electrical connector. Without such movement, attempts to mate improperly aligned connectors can result in substantial damage to one or both connectors and/or to the fragile electrically conductive terminals mounted therein, thereby resulting in a poor quality electrical connection or no electrical connection at all.

The present invention is directed to providing various features in an electrical connector and its mounting system that improves the manufacturability, the assembly and/or the use of electrical connectors in environments wherein it is desirable to have some degree of movement of the connector relative to its mounting support structure and to facilitate mating the electrical connector to a complementary mating assembly.

SUMMARY OF THE INVENTION

An object, therefore, of the invention is to provide a new and improved frame structure for mounting an electrical connector assembly.

In the exemplary embodiment of the invention, the frame structure includes a generally U-shaped first frame piece having a pair of generally parallel arms for embracing opposite sides of the connector assembly inserted into an open side of the frame piece defined by the U-shaped configuration thereof. A second frame piece closes the open side of the first frame piece to capture the connector assembly therewithin. Complementary interengaging latch means are provided between opposite ends of the second frame piece and free ends of the arms of the U-shaped first frame piece to hold the frame pieces together about the connector assembly.

As disclosed herein, the insides of the arms of the U-shaped first frame piece include guide tracks for slidably receiving flange portions of the connector assembly inserted into the first frame piece between the arms thereof. The arms include ramps for leading the flange portions of the connector assembly into the guide tracks. The latch means is provided by cantilevered flexible latch arms on one of the frame pieces and anti-overstress means for the latch arms on the other frame piece.

Another feature of the invention involves the provision of complementary interengaging spacing means between opposite ends of the second frame piece and the free ends of the arms of the U-shaped first frame piece to maintain a predetermined spacing between the arms. The spacing means include a first pair of tabs respectively at opposite ends of the second frame piece for engaging inside surfaces on the arms to bias the arms outwardly toward the predetermined spacing. A second pair of tabs at opposite ends of the second frame piece are engageable with outside surfaces on the arms to bias the arms inwardly toward the predetermined spacing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
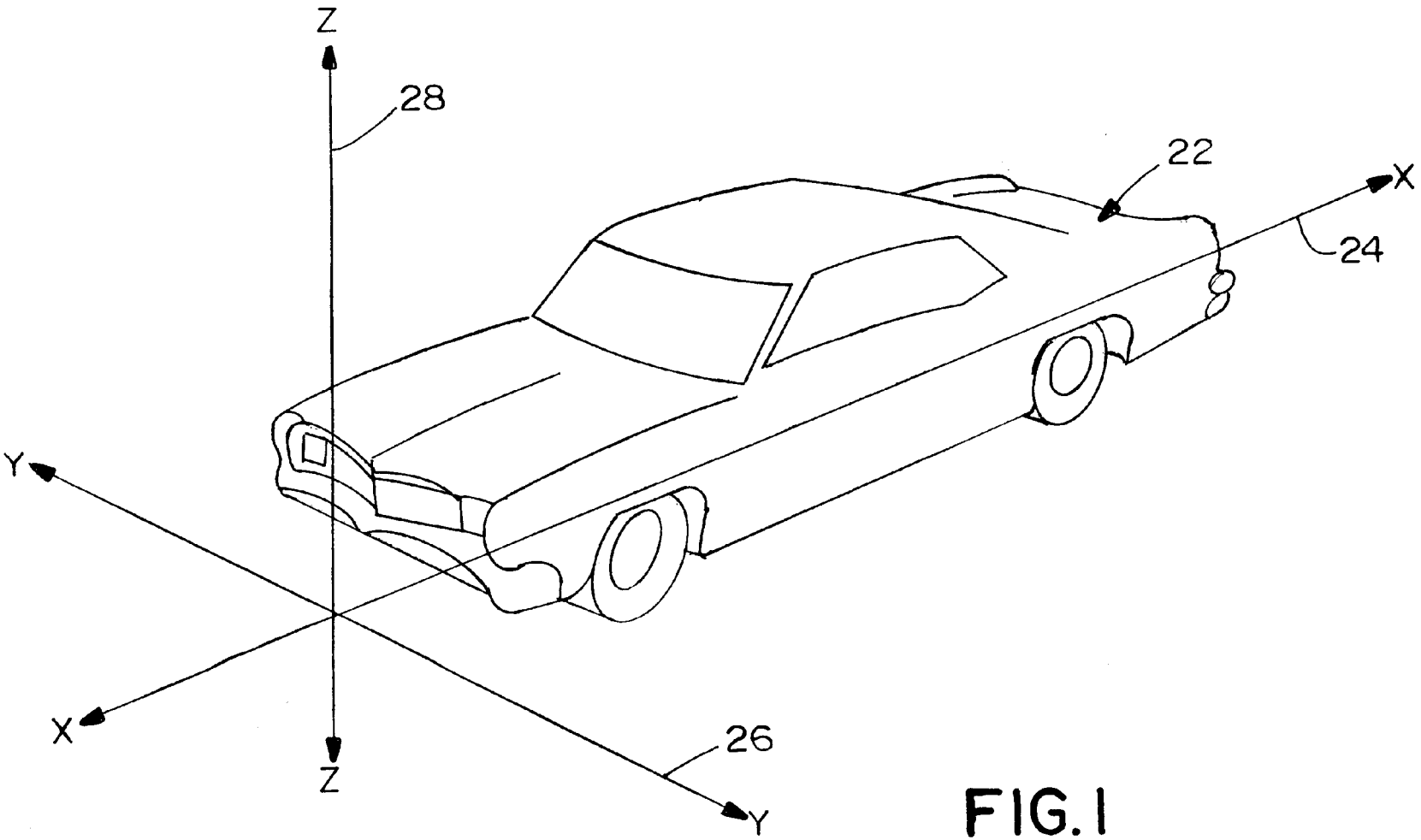
FIG. 1 is a somewhat schematic perspective view of an automobile as it might travel relative to an assembly line, showing the various assembly axes.

Referring to the drawings in greater detail, and first to FIG. 1, the electrical connector mounting system and other features of the invention are particularly applicable for use in automotive applications, such as in an automobile, generally designated 22. The automobile is shown in reference to various axes as might be referenced in an automotive assembly line. Double-headed arrow 24 represents the "X" axis running horizontally in a front-to-rear direction of the automobile. Double-headed arrow 26 represents the horizontal axis "Y" running transversely of the automobile. Double-headed arrow 28 represents the "Z" or vertical axis. Of course, it should be understood that the mounting system and other features of the invention are equally applicable for a wide variety of applications other than that simply of automotive or other vehicular uses.

Figure 2:
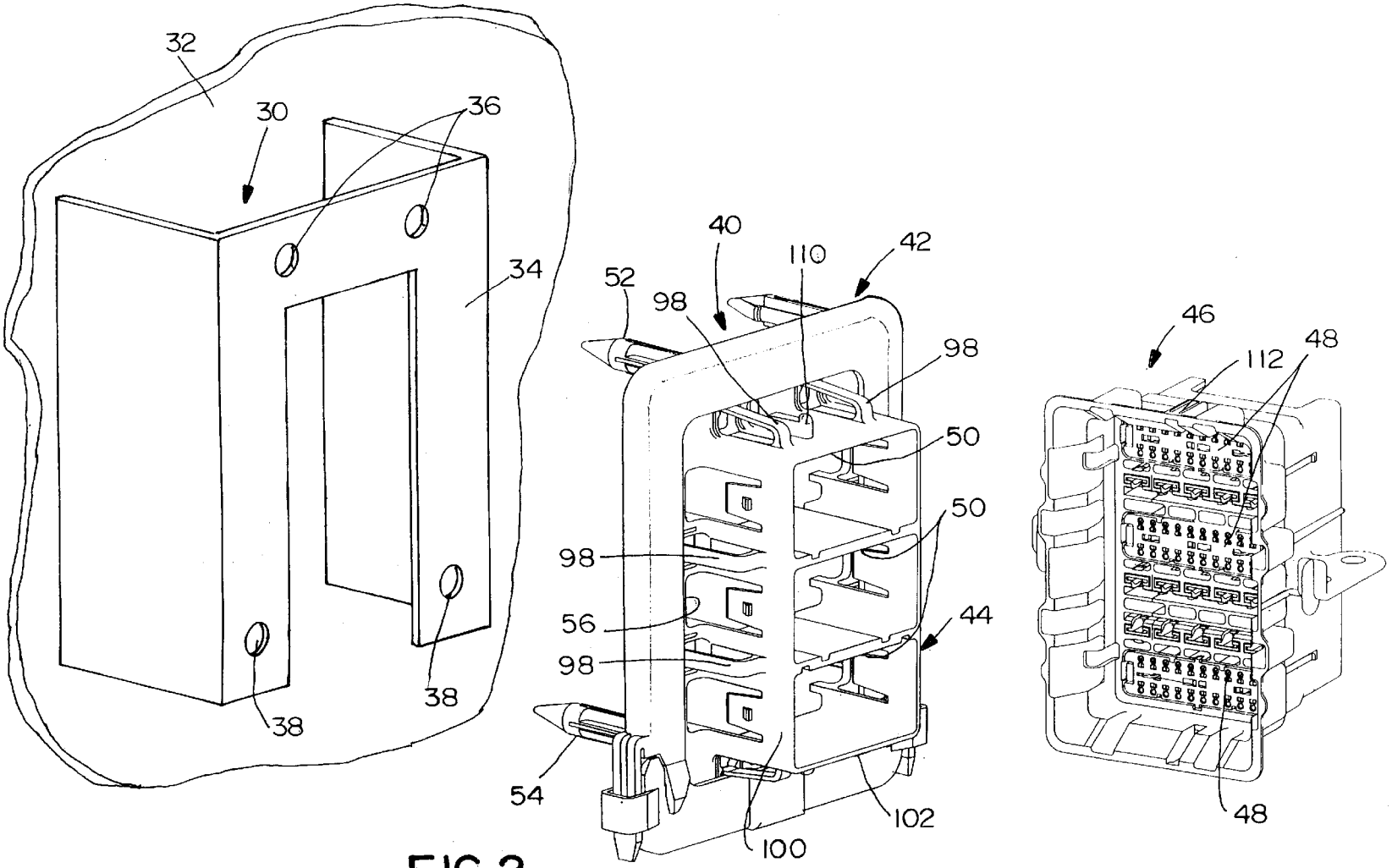
FIG. 2 is an exploded perspective view of the electrical assembly and mounting system of the invention.
Figure 3:
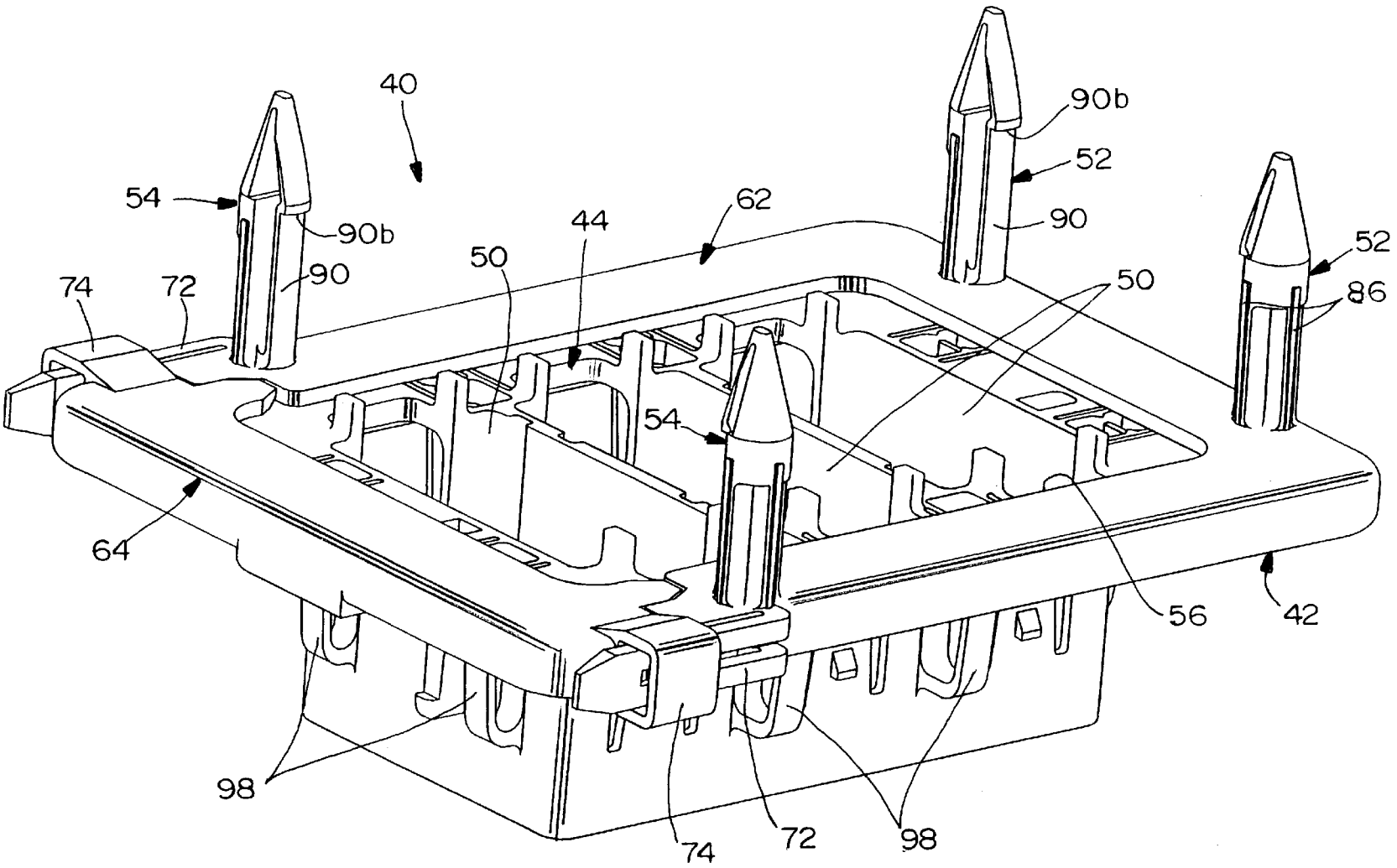
FIG. 3 is a perspective view of the rear side of the receptacle holding assembly.
Figure 5:
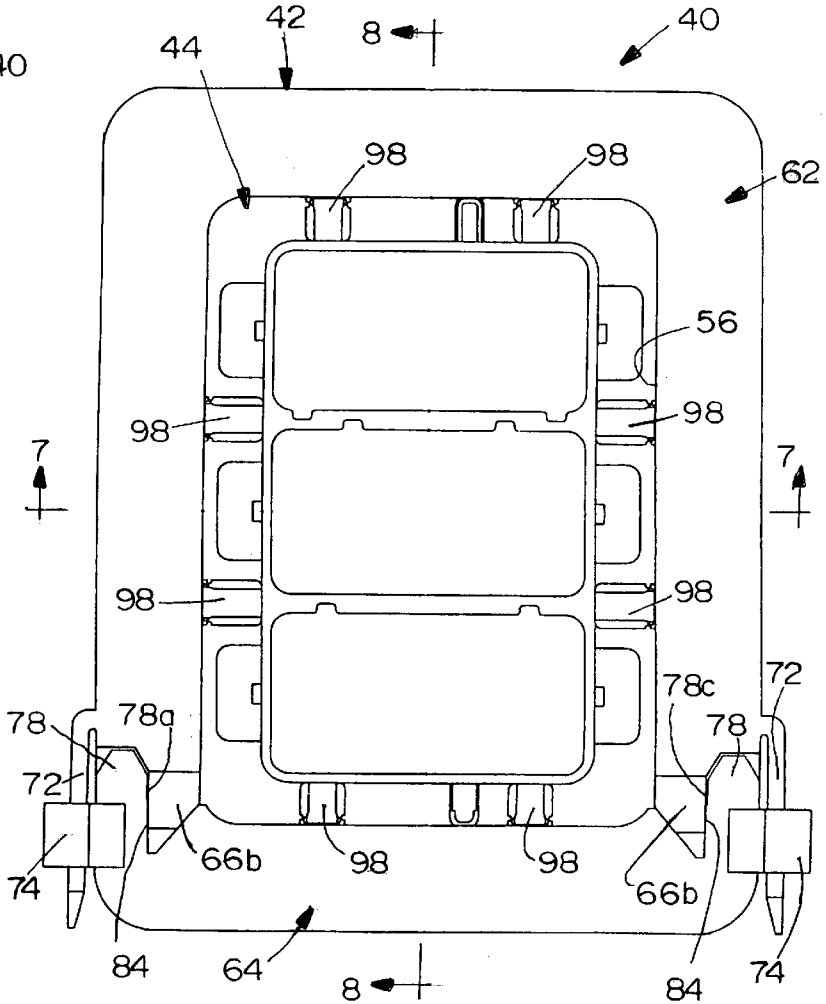
FIG. 5 is a front elevation of the receptacle holding assembly.

FIG. 2 shows an exploded perspective depiction of an overall electrical connector assembly mounting arrangement as might be used in assembling automobile 22. Specifically, a support structure, generally designated 30, in the form of a U-shaped main bracket is secured to a panel 32 behind the dash board of the automobile. The main support bracket includes a face plate 34 spaced from panel 32. The face plate includes an upper pair of generally round mounting holes 36 and a lower pair of generally round mounting holes 38. For purposes described hereinafter, mounting holes 38 are spaced wider than mounting holes 36.

Still referring to FIG. 2, a receptacle holding assembly, generally designated 40, is mounted to support structure 30. The receptacle holding assembly includes an outer bracket or frame structure, generally designated 42, and an inner bracket or housing, generally designated 44. As will be understood hereinafter, the entire receptacle holding assembly 40 is provided with self-alignment relative to support structure 30 in the "X" (FIG. 1) axis, and inner bracket or housing 44 is provided with self-alignment relative to outer bracket or frame structure 42 in the "Y" and "Z" axes.

Finally, a complementary mating second connector, generally designated 46 in FIG. 2, is connectable with receptacle holding assembly 40, particularly inner bracket or housing 44. Mating connector 46 may be secured to the rear of the dashboard of the vehicle and the entire assembly moved toward panel 32 for engaging connector 46 with receptacle holding assembly 40. Mating connector 46 houses three connector subassemblies 48 which respectively mount a plurality of electrical terminals. Inner housing 44 of receptacle holding assembly 40 includes three receptacles 50 which house three modular connectors (not shown) which respectively mount a plurality of electrical terminals for interconnection with the terminals of connectors 48.

Figure 7:
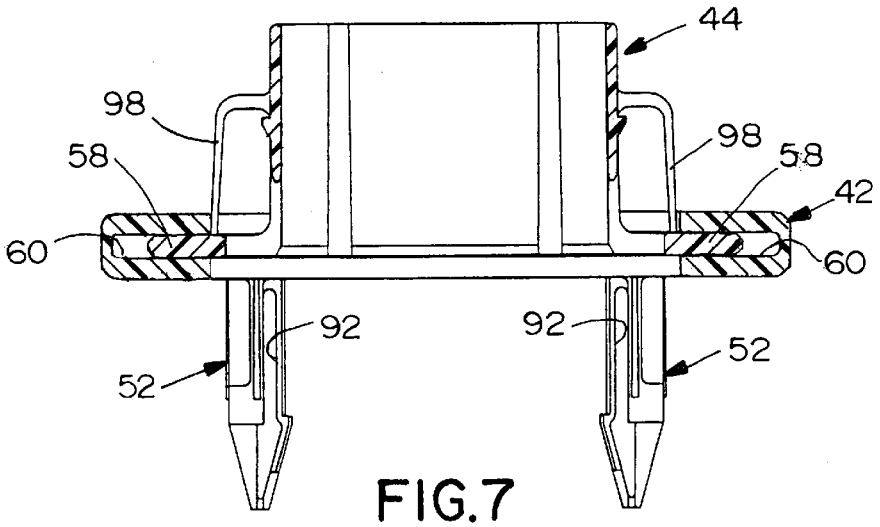
FIG. 7 is a horizontal section taken generally along line 7—7 of FIG. 5.
Figure 8:
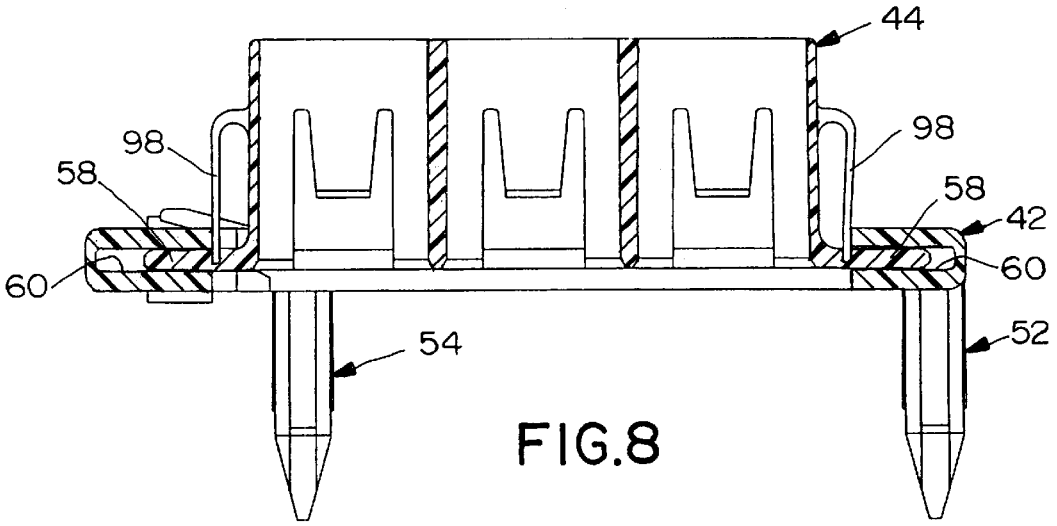
FIG. 8 is a vertical section taken generally along line 8—8 of FIG. 5.

FIGS. 3–8 show in greater detail the assembly of receptacle holding assembly 40 (FIG. 1). In particular, as stated above, receptacle holding assembly 40 includes outer bracket or frame structure 42 and inner bracket or housing 44 with its three receptacles 50. Suffice it to say at this point, outer frame structure 42 includes two pairs of mounting posts, generally designated 52 and 54, for insertion into the two pairs of mounting holes 36 and 38, respectively, in main bracket or support structure 30 (FIG. 2). Outer frame structure 42 defines a mounting aperture 56 which is seen best in FIGS. 4 and 5, within which inner housing 44 is mounted. As best seen in FIGS. 7 and 8, inner housing 44 includes peripheral side flanges 58 which slide into guide tracks 60 in outer frame structure 42.

FIGS. 9–15 show in greater detail the specific structure of outer bracket or frame structure 42 of receptacle holding assembly 40. More particularly, outer frame structure 42 is a two-part structure including a generally U-shaped first frame piece, generally designated 62, and an elongated second frame piece, generally designated 64. The frame pieces are shown disassembled in FIG. 9. When the frame pieces are assembled, they define closed mounting aperture 56 within which inner bracket or housing 44 (FIG. 2) is mounted.

Figure 9:
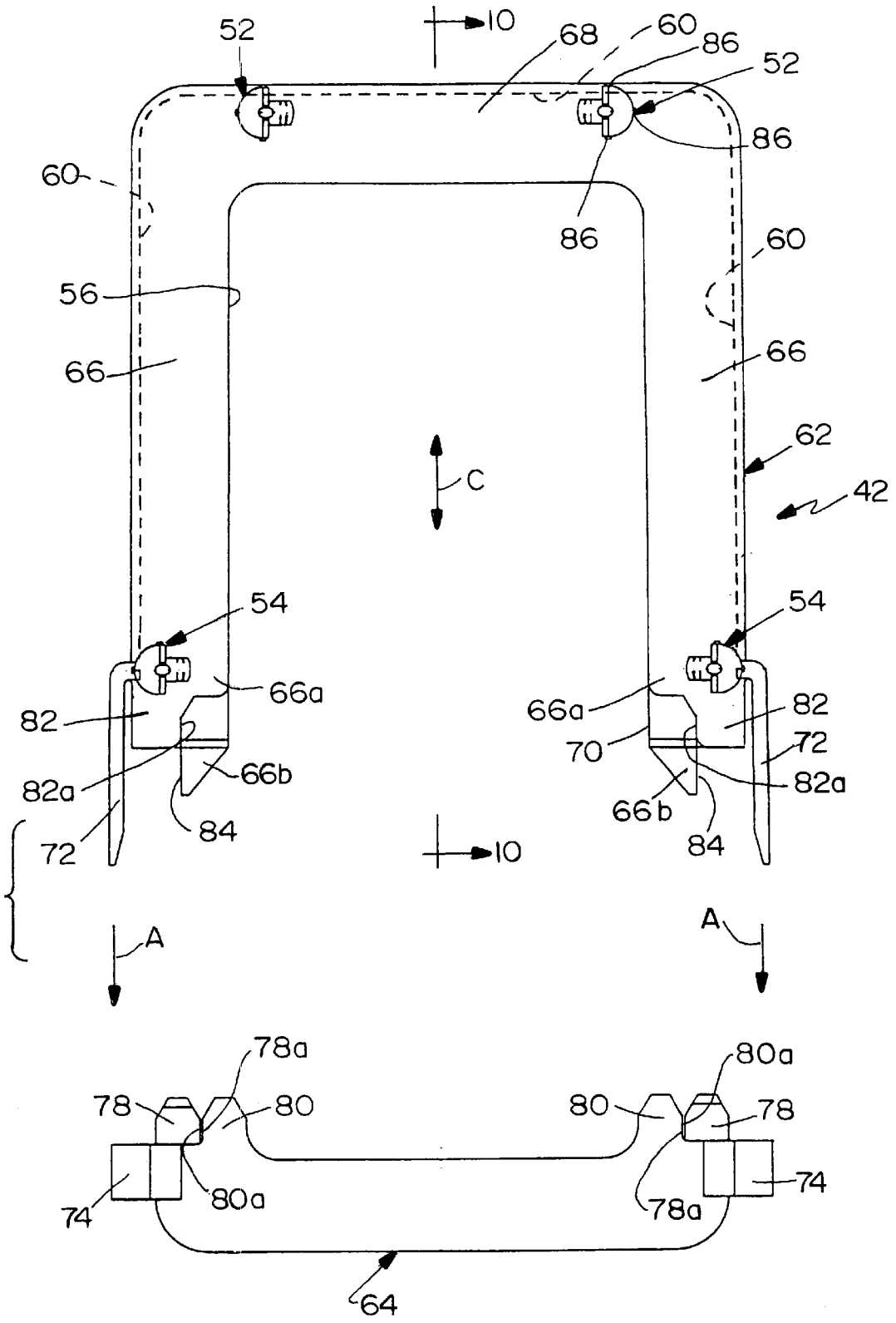
FIG. 9 is a rear elevation of the outer bracket or frame structure of the receptacle holding assembly, in disassembled condition.
Figure 12:
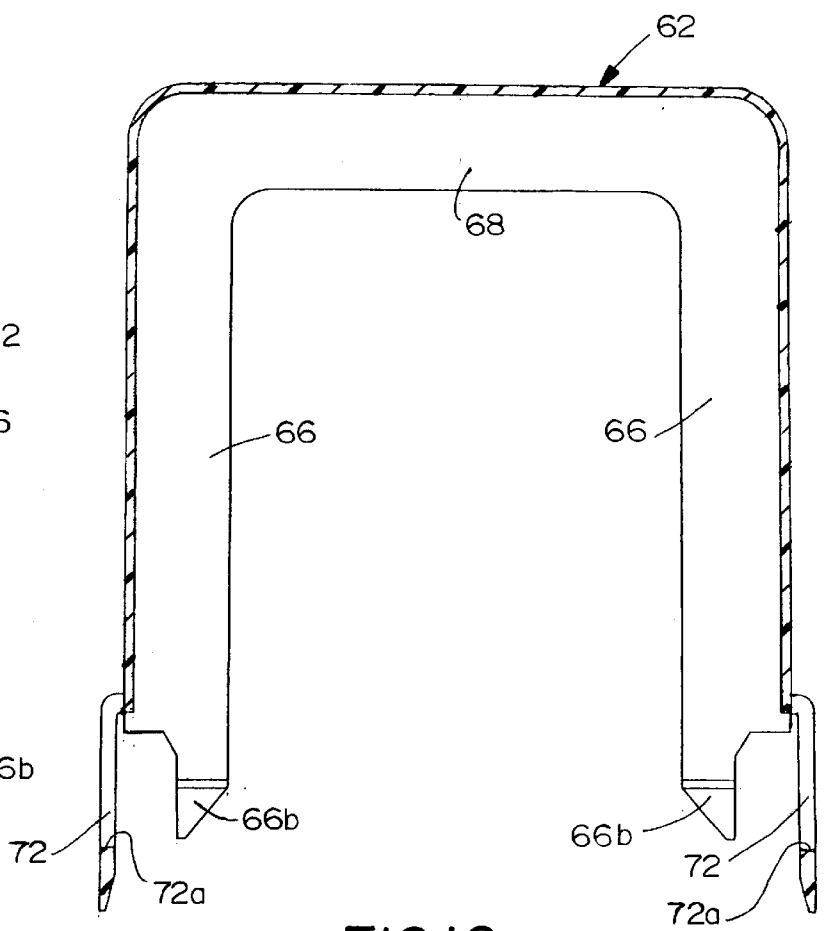
FIG. 12 is a vertical section taken generally along line 12—12 of FIG. 11.
Figure 11:
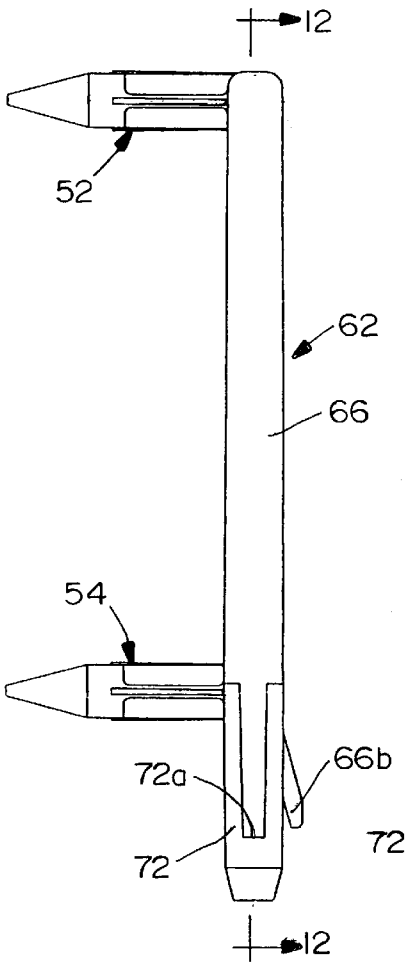
FIG. 11 is a side elevational view of the U-shaped portion of the outer bracket.
Figure 10:
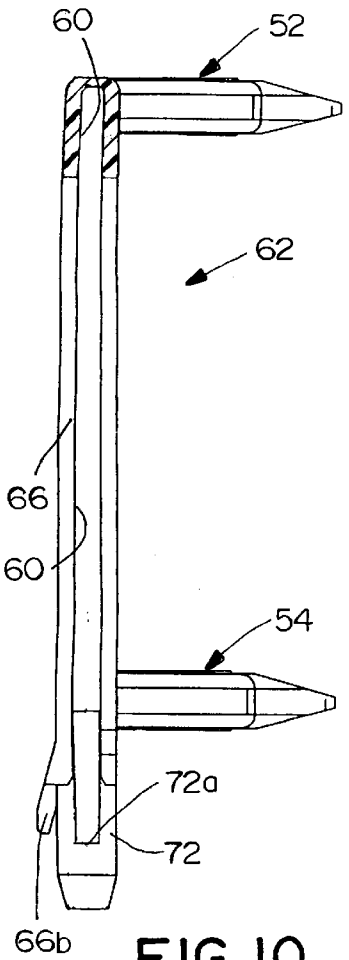
FIG. 10 is a vertical section taken generally along line 10—10 of FIG. 9.
Figure 13:
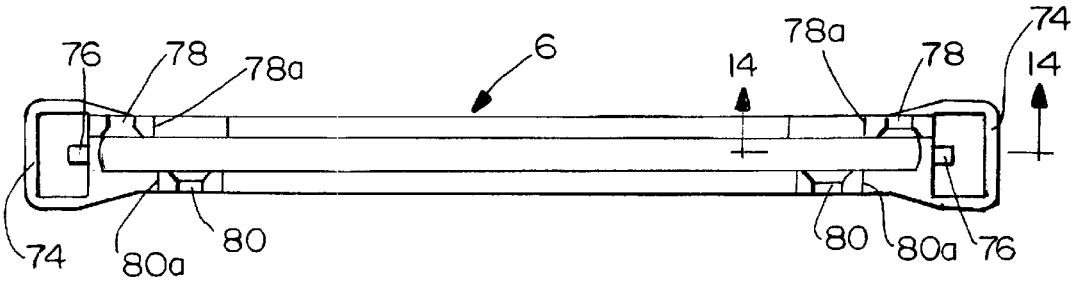
FIG. 13 is a bottom plan view of the second portion of the outer bracket.
Figure 14:
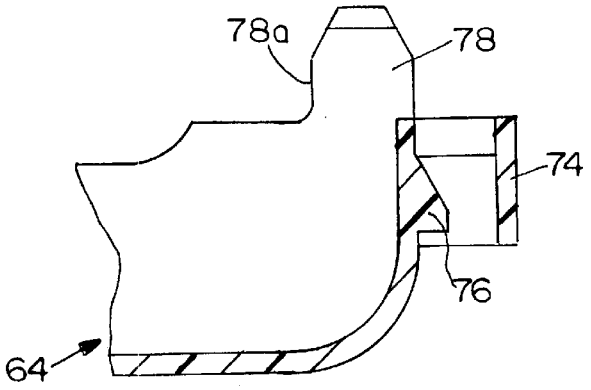
FIG. 14 is a fragmented section taken generally along line 14—14 of FIG. 13.

The U-shaped first frame piece 62 of outer frame structure 42 includes a pair of generally parallel arms 66 joined by a cross-arm 68 which defines the bight portion of the U-shaped configuration. Parallel arms 66 define an open side 70 of the first frame piece which, in assembly, is closed by second frame piece 64. First frame piece 62 has a pair of flexible latch arms 72 cantilevered from the outside of distal ends 66*a* of arms 66 as best seen in FIG. 9. The arms have openings to define latch shoulders 72*a* as best seen in FIGS. 10 and 12. In assembly, latch arms 72 are inserted through a pair of bridges 74 at opposite ends of second frame piece 64 in the direction of arrows "A" (FIG. 9). When fully assembled, latch shoulders 72*a* of the flexible cantilevered latch arms snap behind latch bosses 76 (FIG. 13) located inside bridges 74 of the second frame piece. When assembled, bridges 74 provide an anti-overstress means to prevent cantilevered latch arms 72 from being pulled outwardly from the assembly which might break or overstress the latch arms.

Side arms 66 of first frame piece 62 have flared flanges 66*b* projecting axially from distal ends 66*a* of the arms as best seen in FIGS. 9–12. This facilitates guiding flanges 58 (FIGS. 7 and 8) of inner housing 44 into guide tracks 60 within the arms of first frame piece 62.

Generally, first and second frame pieces 62 and 64, respectively, include complementary interengaging spacing means between opposite ends of second frame piece 64 and the free or distal ends 66*a* of arms 66 of the U-shaped first frame piece 62, to maintain a predetermined spacing between arms 66. More particularly, as best seen in FIG. 9, second frame piece 64 includes a pair of outer tabs 78 defining inwardly facing camming surfaces 78*a*, and a pair of inner tabs 80 defining outwardly facing camming surfaces 80*a*. Distal ends 66*a* of arms 66 of first frame piece 62 include outer tabs 82 having inwardly facing camming surfaces 82*a* and flared flanges 66*b* define outwardly facing camming surfaces 84. It can be seen that the tips of tabs 78 and 80 are tapered or chamfered to facilitate engagement of the various camming surfaces on the two frame pieces.

The complementary interengaging spacing means provided by tabs 78,80,82 and flanges 66*b*, along with their respective camming surfaces, provide a means for maintaining precise spacing between side arms 66 of the U-shaped first frame piece 62. During the molding process of the U-shaped member, upon curing, side legs 66 may not be at a desired predetermined spacing. Therefore, the assembly of second frame piece 64 to the U-shaped frame piece will establish the precise spacing. In other words, if arms 66 are spaced apart too wide, camming surfaces 78*a* of outer tabs 78 will engage camming surfaces 84 of flared flanges 66*b* to draw arms 66 inwardly toward their precise spacing. This engagement can be seen in FIG. 5. If the arms are spaced too close to each other, camming surfaces 80*a* of tabs 80 will engage camming surface 82*a* of tabs 82 and move the arms outwardly toward their precise spacing. This engagement can be seen in FIG. 4.

FIGS. 2–4, 9, 10 and 15 show a unique configuration of mounting posts 52 and 54 of outer bracket or frame structure 42. Actually, the mounting posts project from the U-shaped first frame piece 62 of the outer bracket or frame structure. As seen best in FIGS. 3, 4 and 9, the pair of mounting posts 52 are spaced closer together than the pair of mounting posts 54. Therefore, mounting posts 52 are insertable into round holes 36 (FIG. 2) of main support bracket 30, and mounting posts 54 are insertable into holes 38 in the main support bracket. The reason for this differential spacing of the respective pairs of mounting posts will be described below. Otherwise, each mounting post has an identical structural configuration.

Figure 15B:
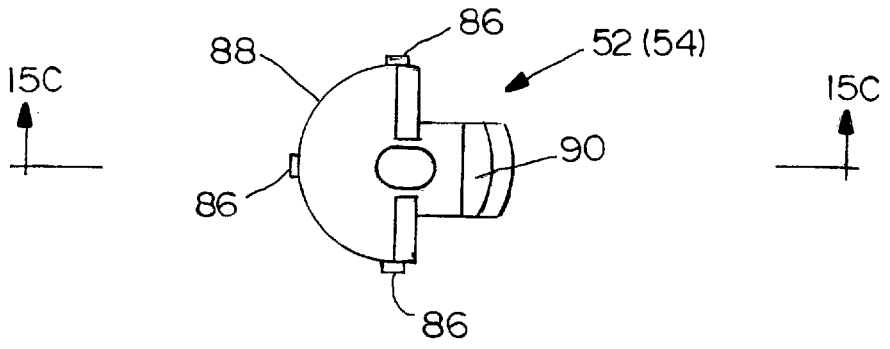
FIG. 15B is an end view of one of the mounting posts.
Figure 15A:
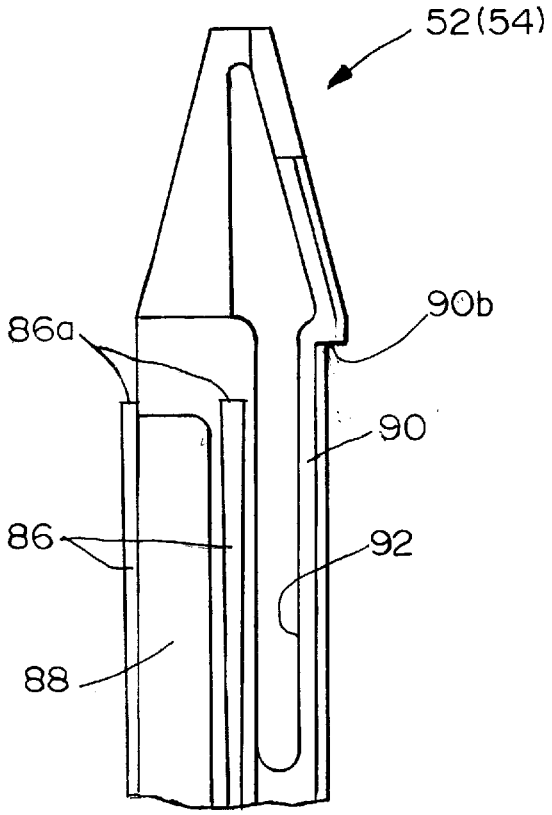
FIG. 15A is a side elevational view of one of the mounting posts of the outer bracket.
Figure 15C:
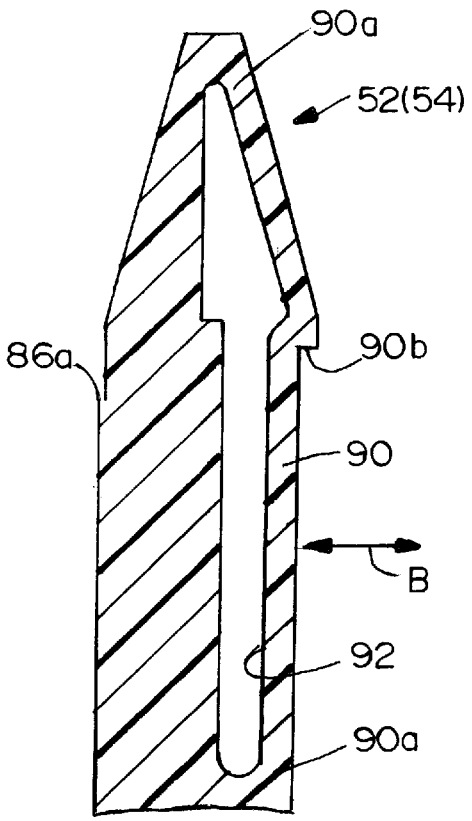
FIG. 15C is a section taken generally along line 15C—15C of FIG. 15B.

More particularly, each mounting post 52,54 has a generally round envelope as defined by three rigid crush ribs 86 extending lengthwise of the post and spaced from each other circumferentially about a major side 88 of the post as best seen in FIGS. 15A–15C. Preferably, at least a pair of the crush ribs are diametrically disposed on opposite sides of the post. As disclosed herein, three of the crush ribs are equally spaced relative to each other in three quadrants about the post as best seen in FIG. 15B. A flexible arm 90 extends lengthwise of each post on a side of the post opposite major side 88, i.e. in the fourth quadrant of the post, such that the flexible arm is located equidistant from the two diametrically disposed crush ribs as seen best in FIG. 15B. The flexible arm has opposite ends 90*a* fixed to the post and spaced outwardly therefrom to define a flexing space 92 behind the arm as best seen in FIGS. 15A and 15C. Therefore, the flexible arms can flex relative to the post in the direction of double-headed arrow "B" (FIG. 15C). A latch hook 90*b* is formed on the outside of flexible arm 90 intermediate opposite ends 90*a* thereof. Finally, the tip of each post is tapered or pointed, as at 94, to facilitate insertion into its respective hole 36,38 of main support bracket 30.

The overall envelope of each mounting post 52 (54) is such that the effective diameter of the post defined by crush ribs 86 and flexible arm 90 is greater than the diameter of mounting holes 36 and 38. Therefore, arm 90 will flex and ribs 86 will at least partially crush when the post is inserted into its respective mounting hole. However, it should be noted particularly in FIGS. 15A and 15C that latch hook 90*b* is closer to the distal end of the mounting post than the outer ends 86*a* of crush ribs 86. This differential in axial spacing between the latch hooks of the mounting posts and the ends of the crushed ribs provide a preliminary mounting position for receptacle holding assembly 40 (FIG. 2) on main support bracket 30, before crush ribs 80 begin to deform. In the automotive application described above in relation to FIGS. 1 and 2, mating second connector 46 (FIG. 2) is mated with receptacle holding assembly 40 along the "X" axis (FIG. 1). During mating, the terminals of connectors 48 of mating connector 46 interengage with the terminals of the modular connectors within receptacles 50 of inner housing 44 while receptacle holding assembly 40 is in its preliminary mounting position defined by latch hooks 90*b* of mounting posts 52,54 (i.e. before any deformation of crush ribs 86). However, if there is any overtravel of the mechanisms along the "X" axis in a forward, mating direction, crush ribs 86 are capable of deforming to accommodate this overtravel and still securely mount receptacle holding assembly 40 to main support bracket 30.

One embodiment of the invention, involving crush ribs 86, facilitates maintaining a substantially constant insertion force of mounting posts 52,54 into mounting holes 36, 38. More particularly, as best seen in FIG. 15A, the width of the crush ribs as well as the thickness of the crush ribs are gradually reduced from ends 86*a* of the ribs toward arms 66 of outer bracket 42. The crush ribs are gradually reduced in cross section in a direction away from distal ends 86*a* of the ribs to facilitate maintaining a substantially constant insertion force of the mounting posts into the mounting holes. This gradual reduction in the cross sectional dimensions of the crush ribs also reduces the build-up of plastic fragments caused by deformation of the ribs. However, it is not necessary to the invention that the cross section of the crush ribs be reduced. In some applications, the cross section of the crush ribs may be maintained at a constant dimension or at a gradually increasing dimension depending on the insertion and retention force requirements thereof.

Figure 4:
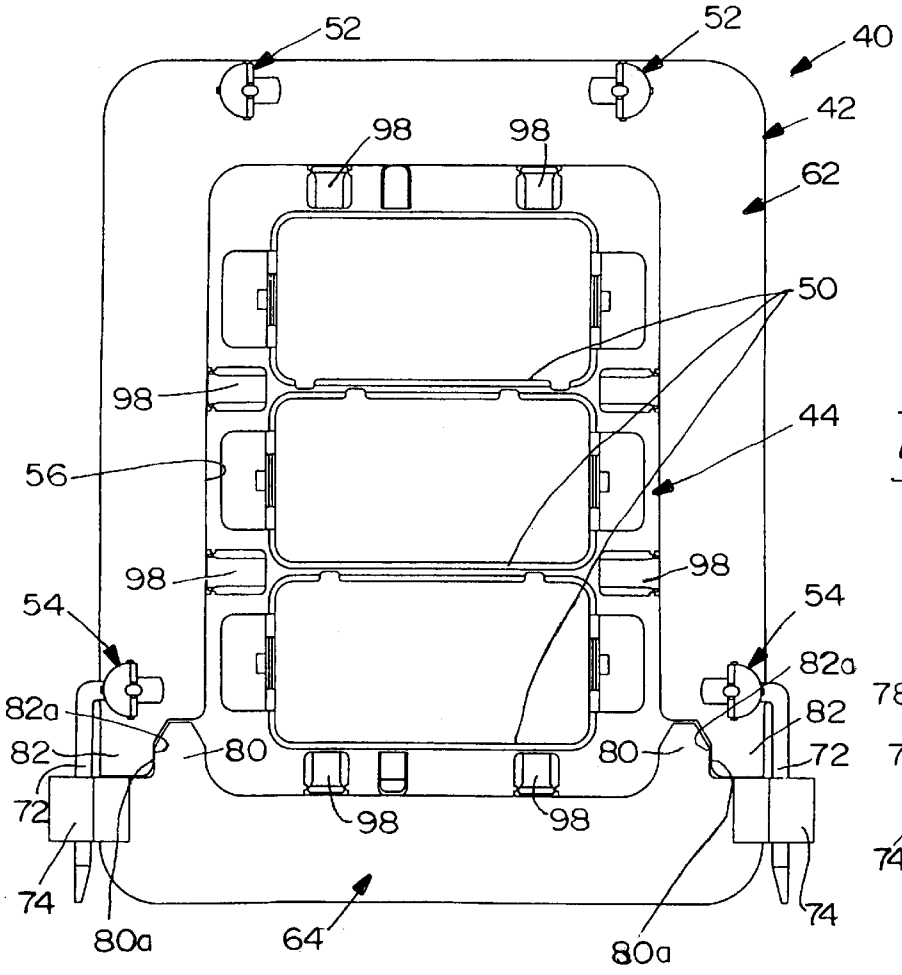
FIG. 4 is a rear elevation of the receptacle holding assembly.
Figure 6:
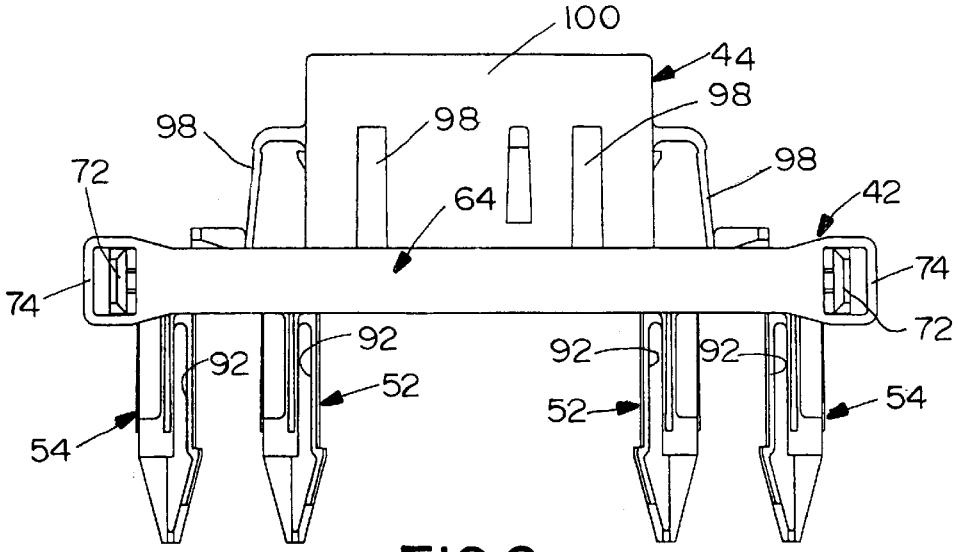
FIG. 6 is a bottom plan view of the receptacle holding assembly.

As stated above, the pair of mounting posts 52 are spaced closer to each other than the spacing between the pair of mounting posts 54. This is best seen in FIGS. 4 and 9. Correspondingly, FIG. 2 shows that mounting holes 36 (for mounting posts 52) are spaced closer together than mounting holes 38 (for mounting posts 54). The purpose of this differential spacing is to facilitate molding U-shaped frame piece 62 (FIG. 9) in a simple molding fixture having two mold parts which are separable in a mold direction represented by double-headed arrow "C" (FIG. 9). In other words, all of the details of frame piece 62, including guide tracks 60, latch arms 72 and the other components at the distal ends 66*a* of arms 66 can be molded in a separable two-part mold without any side coring. It can be understood from FIG. 9 that the mounting posts are offset relative to each other transversely of mold direction "C" so that no two posts are in alignment in the mold direction. In addition, it can be seen in FIG. 6 that flexing spaces 92 of all of the mounting posts are open in the mold direction so that the mounting posts, along with the other elements of frame piece 62 can be molded with the simple two-part mold. The offset mounting posts serve the additional purpose of polarizing receptacle holding assembly 40 with respect to main support bracket 30 such that it is oriented properly.

FIGS. 16–21 show in greater detail the specific structure of inner bracket or housing 44 which is mounted within outer bracket or frame structure 42 of receptacle holding assembly 40. More particularly, as stated above, inner housing 44 includes the peripheral flange 58 which slides into guide tracks 60 (FIG. 7) of the U-shaped frame piece of outer frame structure 42. In addition, as stated above, inner housing 44 has three receptacles 50 for mounting appropriate modular connectors (not shown) for mating with complementary connectors 48 (FIG. 2) of mating connector 46. Inner housing 44 is mounted in outer frame structure 42 so that the receptacles project through mounting aperture 56 in the outer frame structure as best seen in FIG. 2. Finally, inner housing 44 has a unique self-aligning mounting system for mounting the entire inner housing and its modular connectors within outer frame structure 42.

Figure 21:
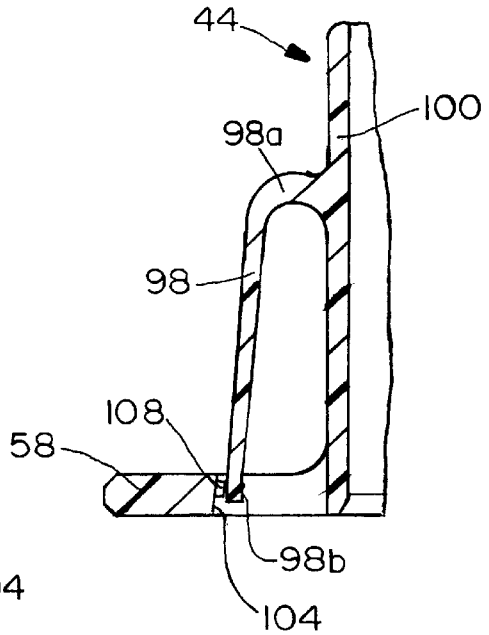
FIG. 21 is a further enlarged section taken generally along line 21—21 of FIG. 20.

More particularly, inner housing 44 includes two deflectable aligning beams 98 cantilevered from each of the four side walls 100 which define receptacles 50. The deflectable aligning beams are positioned for engagement with the four edges of mounting aperture 56 in outer frame structure 42. Each deflectable aligning beam 98 has a fixed forward end 98*a* and a releasably held rearward or distal end 98*b*. The fixed end is considered "forward", because, as seen in FIG. 2, the deflectable aligning beams are cantilevered rearwardly from a forward mating end 102 of inner housing 44. FIG. 21 best shows one of the deflectable aligning beams 98 with its forward end 98*a* and its distal end 98*b*.

Figure 16:
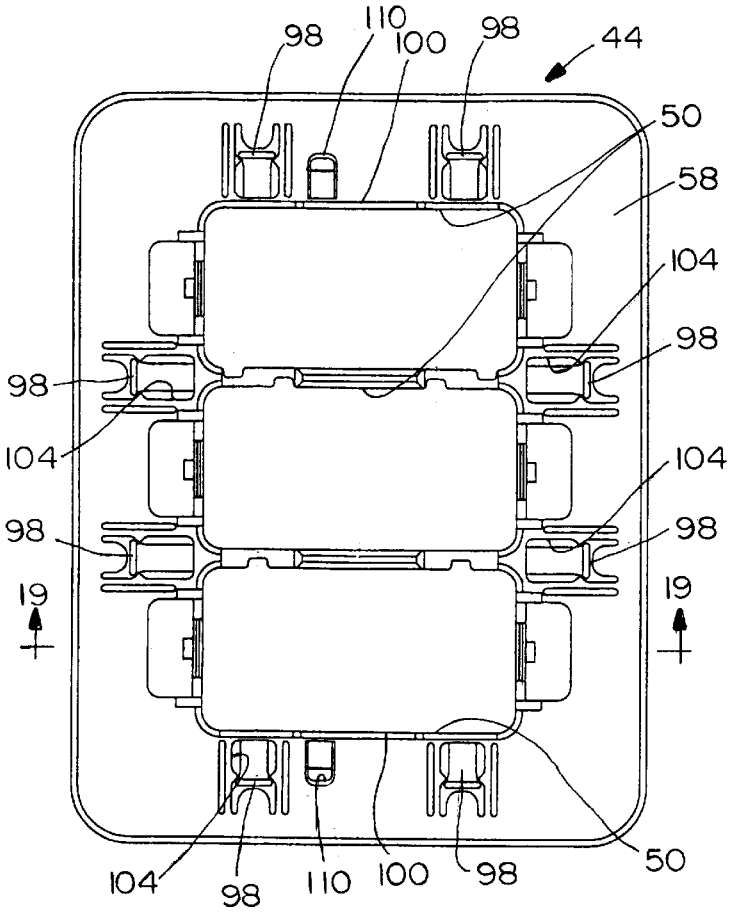
FIG. 16 is a rear elevation of the inner bracket or housing of the receptacle holding assembly.
Figure 17:
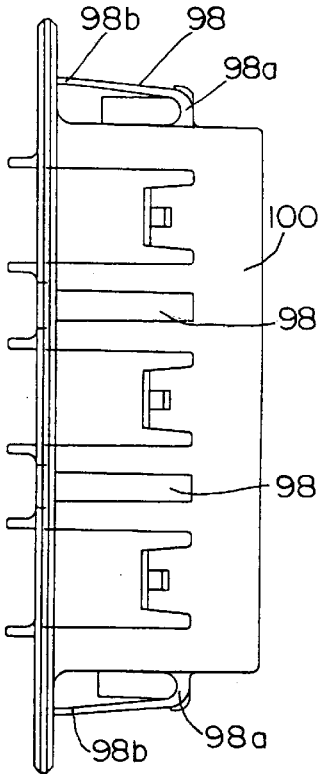
FIG. 17 is a side elevational view of the inner bracket, looking toward the right-hand side of FIG. 16.

Generally, detent means are operatively associated between inner housing 44 and each deflectable aligning beam 98 for holding the beam in an inoperative condition spaced outwardly of the side wall 100 of the housing, whereby the beam can be released to a deflectable condition to facilitate self-aligning inner housing 44 during mating with complementary mating connector 46. More particularly, distal end 98*b* of each deflectable aligning beam 98 projects into a respective opening 104 in peripheral flange 58 of inner housing 44, as best seen in FIG. 16 and the enlarged depictions of FIGS. 20 and 21. A pair of detent bosses 106 project inwardly from opposite sides of each opening 104 behind the distal end of the respective deflectable aligning beam 98 extending into the opening. These detent bosses 106 hold the deflectable aligning beams in inoperative (i.e. non-flexing) condition. The aligning beams are held in their inoperative or pre-load condition during assembly, to maintain inner housing 44 centered within mounting aperture 56 in outer frame structure 42.

Figure 20:
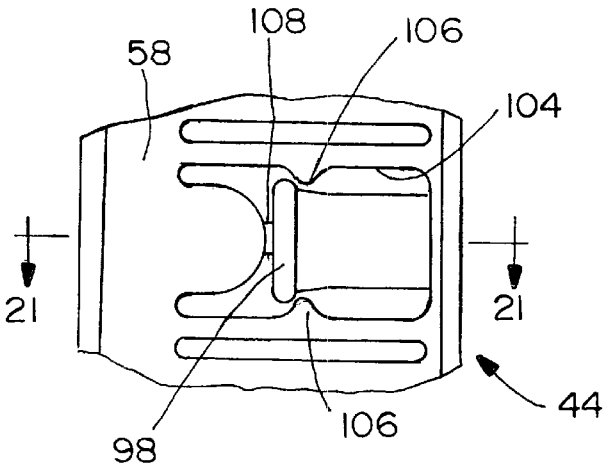
FIG. 20 is an enlarged view of the detent area for one of the aligning beams of the inner bracket.

The invention also contemplates a redundant means to hold deflectable aligning beams 98 in their inoperative (i.e. non-flexing) condition. Specifically, as best seen in FIGS. 20 and 21, a frangible or break-away web 108 is integrally molded between each deflectable aligning beam 98 and inner housing 44. It can be seen that the break-away web is located on the outside of the distal end 98*b* of the aligning beam and the inside wall of opening 104. When it is desired to move the deflectable aligning beams out of their pre-load or inoperative positions, the break-away webs are broken and the distal ends of the beams are free from attachment to the housing. During assembly, rather heavy wiring harnesses or wiring bundles are attached to the modular connectors within receptacles 50, and these loads could tend to move inner housing 44 out of a centered position. Web 108 prevents the inner housing 44 from moving out of position due to the wire harness. In the event that the web breaks prior to engagement of the mating complementary connector 46, detent bosses 106 will maintain the deflectable aligning beams in their inoperative condition. Furthermore, if the aligning beams are inadvertently moved out of position prior to mating, the detent bosses 106 allow the aligning beams to be manually snapped back into place, i.e., into their inoperative position.

Upon mating inner housing 44 to mating connector 46, if the housing and connector are out of alignment, web 108 is broken during mating by the mating forces, and deflectable aligning beams 98 are moved out of their detent or held position behind detent bosses 106, whereupon the aligning beams are free to flex and inner housing 44 is capable of self-alignment within mounting aperture 56 in outer frame structure 42 to allow complete mating with mating connector 46 (FIG. 2). If the housing and connector are perfectly aligned prior to mating, the frangible web is not broken and the aligning beams remain in their inoperative positions during mating. However, the flexure of the beams and self-alignment of the inner housing are not required under such conditions.

Figure 18:
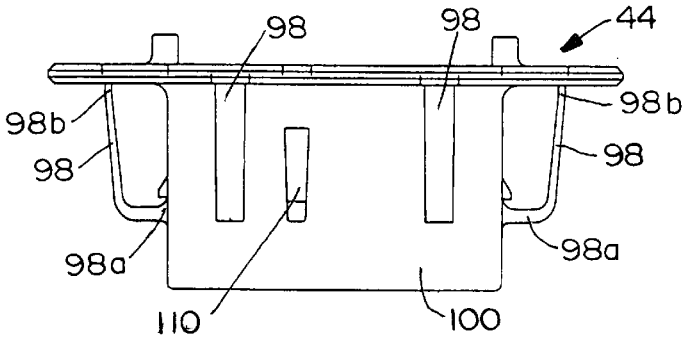
FIG. 18 is a bottom plan view of the inner bracket.
Figure 19:
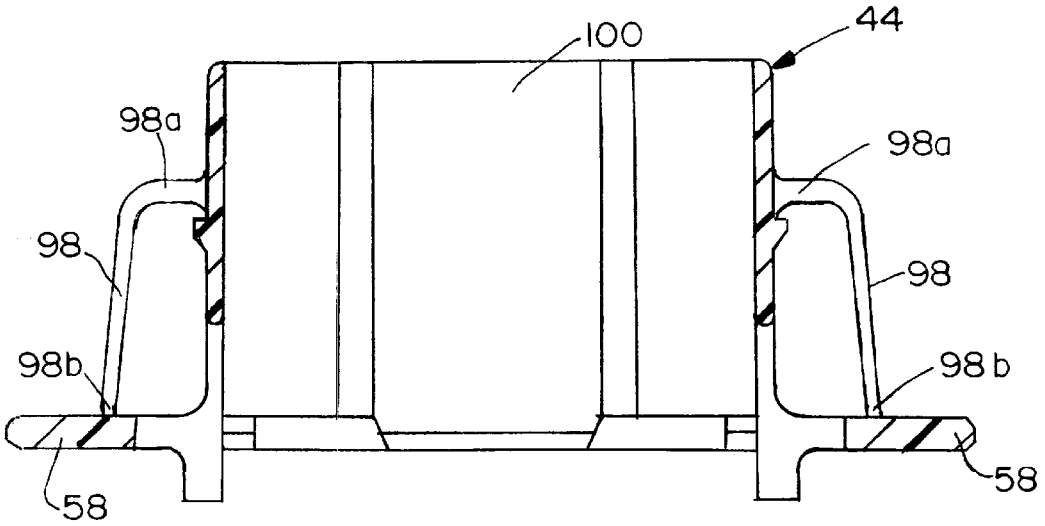
FIG. 19 is a horizontal section taken generally along line 19—19 of FIG. 16.

Finally, as seen best in FIG. 18, inner housing 44 is provided with a latch 110 projecting outwardly from the side wall 100 at each opposite end of the housing for latching engagement with complementary mating second connector 46. FIG. 2 shows one of the latches 110 for latching engagement with a complementary latch 112 on the mating second connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A frame structure for mounting an electrical connector assembly, comprising:

a generally U-shaped first frame piece having a pair of generally parallel arms for embracing opposite sides of the connector assembly inserted into an open side of the frame piece defined by the U-shaped configuration thereof;

a second frame piece for closing the open side of the first frame piece to capture the connector assembly therewithin; and complementary interengaging latch means between opposite ends of the second frame piece and free ends of the arms of the U-shaped first frame piece to hold the frame pieces together about the connector assembly.

2. The frame structure of claim 1 wherein said latch means comprise cantilevered flexible latch arms on one of the frame pieces and anti-overstress means for the latch arms on the other frame piece.

3. The frame structure of claim 1 wherein the insides of the arms of the U-shaped first frame piece include guide tracks for slidably receiving portions of the connector assembly inserted into the first frame piece between the arms thereof.

4. The frame structure of claim 3 wherein the arms of said first frame piece include ramps for leading said portions of the connector assembly into the guide tracks.

5. The frame structure of claim 1, including complementary interengaging spacing means between opposite ends of the second frame piece and free ends of the arms of the U-shaped first frame piece to maintain a predetermined spacing between said arms.

6. The frame structure of claim 5 wherein said spacing means include a pair of tabs respectively at opposite ends of the second frame piece for engaging inside surfaces on said arms to bias the arms outwardly toward said predetermined spacing.

7. The frame structure of claim 5 wherein said spacing means include a pair of tabs respectively at opposite ends of the second frame piece for engaging outside surfaces on said arms to bias the arms inwardly toward said predetermined spacing.

8. The frame structure of claim 7 wherein said spacing means include a second pair of tabs respectively at opposite ends of the second frame piece for engaging inside surfaces on said arms to bias the arms outwardly toward said predetermined spacing.

9. A frame structure for mounting an electrical connector assembly, comprising:

a generally U-shaped first frame piece having a pair of generally parallel arms for embracing opposite sides of the connector assembly inserted into an open side of the frame piece defined by the U-shaped configuration thereof, the insides of the arms including guide tracks for slidably receiving flange portions of the connector assembly inserted into the first frame piece between said arms;

a second frame piece for closing the open side of the first frame piece to capture the connector assembly therewithin;

latch aims projecting from free ends of the arms of the U-shaped first frame piece for engaging latch means at opposite ends of the second frame piece to hold the frame pieces together about the connector assembly; and complementary interengaging spacing means between opposite ends of the second frame piece and the free ends of the arms of the U-shaped first frame piece to maintain a predetermined spacing between said arms.

10. The frame structure of claim 9 wherein the arms of said first frame piece include ramps for leading said portions of the connector assembly into the guide tracks.

11. The frame structure of claim 9 wherein said spacing means include a pair of tabs respectively at opposite ends of the second frame piece for engaging inside surfaces on said arms to bias the arms outwardly toward said predetermined spacing.

12. The frame structure of claim 9, including anti-overstress means at opposite ends of the second frame piece for protecting the cantilevered flexible latch arms projecting from the first frame piece.

13. The frame structure of claim 9 wherein said spacing means include a pair of tabs respectively at opposite ends of the second frame piece for engaging outside surfaces on said arms to bias the arms inwardly toward said predetermined spacing.

14. The frame structure of claim 13 wherein said spacing means include a second pair of tabs respectively at opposite ends of the second frame piece for engaging inside surfaces on said arms to bias the arms outwardly toward said predetermined spacing.

15. A frame structure for mounting an electrical connector assembly, comprising:

a generally U-shaped first frame piece having a pair of generally parallel arms for embracing opposite sides of the connector assembly inserted into an open side of the frame piece defined by the U-shaped configuration thereof;

a second frame piece for closing the open side of the first frame piece to capture the connector assembly therewithin; and complementary interengaging spacing means between the second frame piece and the U-shaped first frame piece to maintain a predetermined spacing between said arms, wherein said spacing means includes a pair of tabs on the second frame piece for biasing said arms toward the predetermined spacing.

16. The frame structure of claim 15 wherein said pair of tabs on the second frame piece engage inside surfaces on said arms to bias the arms outwardly toward said predetermined spacing.

17. The frame structure of claim 15 wherein said pair of tabs on the second frame piece engage outside surfaces on said arms to bias the arms inwardly toward said predetermined spacing.

18. The frame structure of claim 17 wherein said spacing means include a second pair of tabs on the second frame piece for engaging inside surfaces on said arms to bias the arms outwardly toward said predetermined spacing.

* * * * *